US011202489B2

(12) United States Patent
Drust

(10) Patent No.: US 11,202,489 B2
(45) Date of Patent: Dec. 21, 2021

(54) EJECT-ABLE KEY HOLDER AND ORGANIZER

(71) Applicant: Tyler Drust, Playa Vista, CA (US)

(72) Inventor: Tyler Drust, Playa Vista, CA (US)

( * ) Notice: Subject to any disclaimer, the term of this patent is extended or adjusted under 35 U.S.C. 154(b) by 0 days.

(21) Appl. No.: 17/352,743

(22) Filed: Jun. 21, 2021

(65) Prior Publication Data

US 2021/0307469 A1 Oct. 7, 2021

(51) Int. Cl.
*A45C 11/32* (2006.01)

(52) U.S. Cl.
CPC ..... *A45C 11/328* (2013.01)

(58) Field of Classification Search
CPC ..... A45C 11/328; A45C 11/327
USPC ..... 70/465 R; 206/38.1, 37.2
See application file for complete search history.

(56) References Cited

U.S. PATENT DOCUMENTS 2,637,994 A * 5/1953 Harrison, Jr. ..... A45C 11/328 70/456 R
2,640,347 A * 6/1953 Majeski ..... A45C 11/321 70/456 R
3,457,746 A * 7/1969 Glassman ..... A45C 11/328 70/456 R

* cited by examiner

*Primary Examiner* — Andrew D Perreault

(57) ABSTRACT

The invention relates to a key holding device with an ejectable platform that not only retrieves keys but also holds keys in an organized manner. The key holding device comprises a bottom case, a top cover, at least one key holder, and a sliding apparatus to slide the key held in the key holder.

3 Claims, 9 Drawing Sheets

EJECT-ABLE KEY HOLDER AND ORGANIZER

FIELD OF THE INVENTION

The present invention relates to a key holder device for holding and organizing keys. The invention particularly relates to a device that stores keys and conveniently retrieves keys for daily use.

BACKGROUND OF THE INVENTION

Traditional key rings are bulky, create noise, and are cumbersome to use. The organized key holders described in prior art or present on the market require the key blades to be modified before being used in the device. This process of modification wherein the keys are machined to fit the device turns out to be not only expensive but also time consuming as every new key needs to be modified before being installed in the device. Moreover, the modified keys are screwed together thereby preventing easy retrieval from the device if the user wants to change keys.

Furthermore, most of the key holders on the market use the lanyard point to secure the keys which result in a loose fit and keys tend to rattle, jingle and make noise in the key holder.

Therefore, a need remains for a device that holds and organizes off-the shelf, common keys in a secure manner and is able to easily retrieve the said keys for use.

SUMMARY OF THE INVENTION

This Summary is provided to introduce a selection of concepts in a simplified form that are further described below in the Detailed Description of the invention. This Summary is not intended to identify key aspects or essential aspects of the claimed subject matter. Moreover, this Summary is not intended for use as an aid in determining the scope of the claimed subject matter.

The present application discloses an ejectable key holder and organizer and its various components.

It is an object of the invention to provide a key holding device with an ejectable platform that not only retrieves keys but also holds keys in an organized manner. The key holding device comprises a bottom case, a top cover, at least one key holder, and a sliding apparatus to slide the key held in the key holder.

The bottom case provided creates an internal volume wherein the key blades, key holders, sliding component for each key holder can be stored in. The top cover when placed over the bottom case forms a lid which can be secured with fasteners.

It is an additional object of the invention to provide a key holding device comprising a key holder that is designed to fit closely around the external head shape of common, off-the shelf keys. Due to this unique keyholder, the keys stored in the key holder do not need any modification thereby providing an economical means to store and organize keys.

The unique key holder consists of two plates which are enclosed on three consecutive sides to form an internal volume to store & hold contents like, but not limited to, the head of the key blade being inserted. The opening formed on the fourth side of two plates is U-shape to further facilitate the insertion and holding of the head of the key blade. The key holder further consists of a few compressible keeper plugs located on the inside of both plates and a snap-fit feature in the center of one plate that includes a U-shaped pin along with a ramp projection. The keeper plugs are compressed when the key is inserted into the key holder and put a preload against the head of the key blade that is being held in the other direction by the snap-fit feature. When the key is first inserted into the key holder, the ramp along with the keeper plugs, pinches and holds the key in a symmetrical 3-point triangular formation wherein the ramp is pushed out of the way and holds the key back. This further compresses the keeper plugs which in return pushes the key forward followed by the ramp snapping back in its place immediately in the lanyard point of the key blade. The keeper plugs along with the snap-fit feature clenches and secures the key firmly in its place. The U-shaped pin at the back of the plate acts as a shear pin.

It is a further object of this invention to provide a key holding device further comprising a sliding apparatus to slide the keys held in the key holder. The sliding component, helps in retrieving and locking the keys from the key holding device, consists of a lower sliding port and an upper sliding port and both are connected to each other through a slider lock and spring.

It is still another object of this invention to provide a key holding device, wherein the key holder and the lower sliding port are linked with each other through an interlock slide connector. The interlock slide connector is provided at one closed side of the two enclosed plates of the key holder and on the side of the lower sliding port.

It is yet another object of this invention to provide a key holding device that secures the keys firmly in their place thereby preventing any rattling noise when locked in.

In a preferred embodiment, a key holding device and organizer for holding off-the shelf, unmodified keys comprises of a U-shaped rectangular bottom case including a base and a perimeter sidewall extending upwardly from two opposite sides of the base thereby providing an internal volume for storage wherein the bottom case consists of a groove running lengthwise on the inside of the base for each key wherein the said groove supports sliding and ejecting the key in & out, at least one clear rectangular divider placed between keys, at least one channel running lengthwise for holding the said divider in its place; a rectangular top cover having a top surface and perimeter sidewall extending downwards from the top surface wherein the top surface is secured by fasteners over the upper end of the bottom case to form a lid.

Further, it consists of at least one key holder to fit closely around the external head shape of the key wherein the key holder consists of two plates wherein both the plates are enclosed on three sides thereby forming a U shaped opening on one end for holding the head of the key and the opposite side to the U-shaped opening is extended to include an interlock slide connector, at least few compressible keeper plugs on the inside of both plates, a U-shaped snap-fit feature in the center of one plate, wherein the snap-fit feature has a U-shaped pin and a projected ramp in the center. The said ramp and the said keeper plugs are compressed when the head of the key is inserted thereby clamping and holding the head of the key blade in place in the key holder. A sliding apparatus to slide the key held in the key holder through the groove inside of the base of the bottom case consists of a lower sliding port with an interlock slide connector on the side and an upper sliding port which, when actuated by the user, slides and glides the key in & out of the device.

These together with other objects and advantages which will become subsequently apparent reside in the details of the invention as more fully described and claimed, reference being had to the accompanying drawings forming a part thereof, wherein like numerals refer to like parts throughout.

BRIEF DESCRIPTION OF THE DRAWINGS

The novel features of the invention, as well as the invention itself, both as to its structure and its operation will be best understood from the accompanying drawings, taken in conjunction with the accompanying description, in which similar reference characters refer to similar parts, and in which:

FIG. 2: shows a left side view of a key holding device showing one key retrieved or in use whereas one key is locked in;

DETAILED DESCRIPTION OF THE INVENTION

Figure 1:
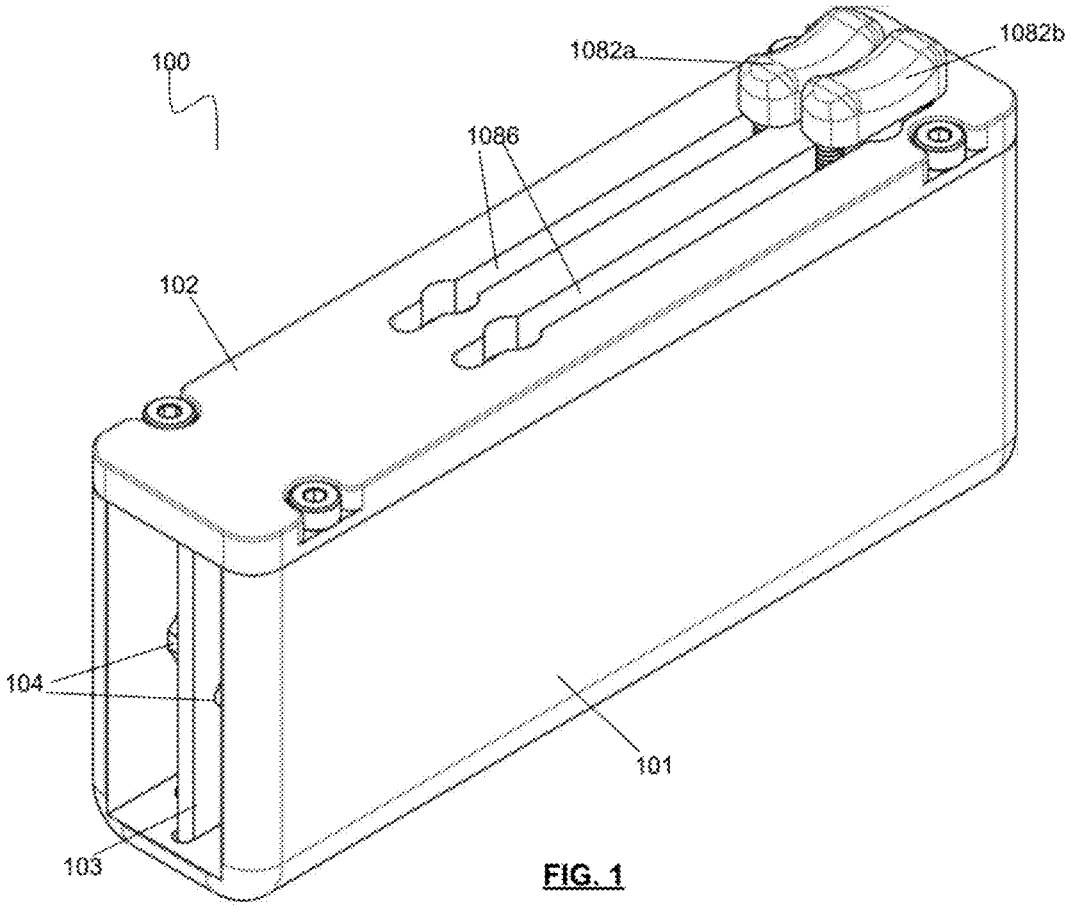
FIG. 1: shows a left side view of a preferred embodiment of a key holding device and organizer according to the invention.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skill in the art without departing from the scope of the invention.

FIG. 1 shows a full view of a key holding device 100 according to the present invention. As illustrated in FIG. 1, the key holding device 100 of the present invention has a bottom case 101 and a top cover 102 that holds the keys in a secure and organized manner.

Figure 2:
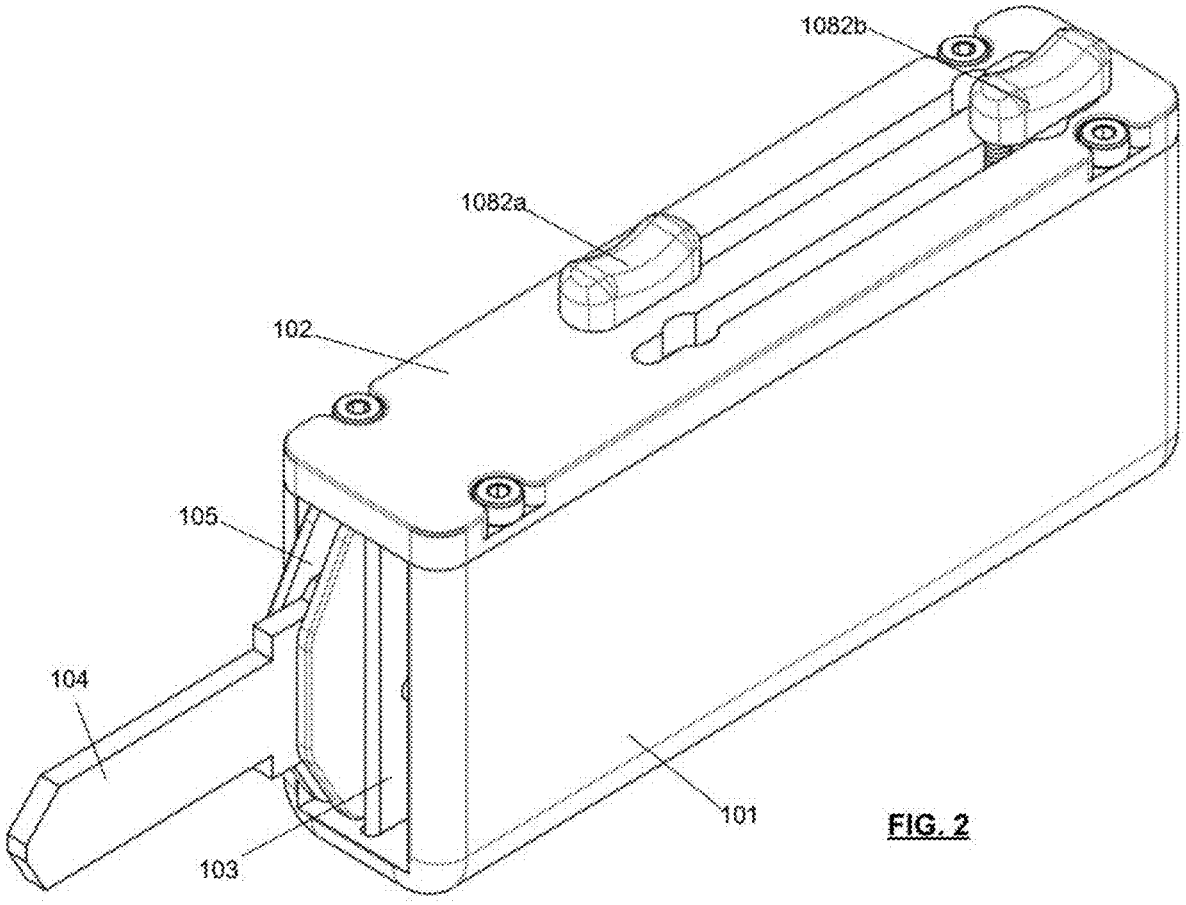
Figure 3:
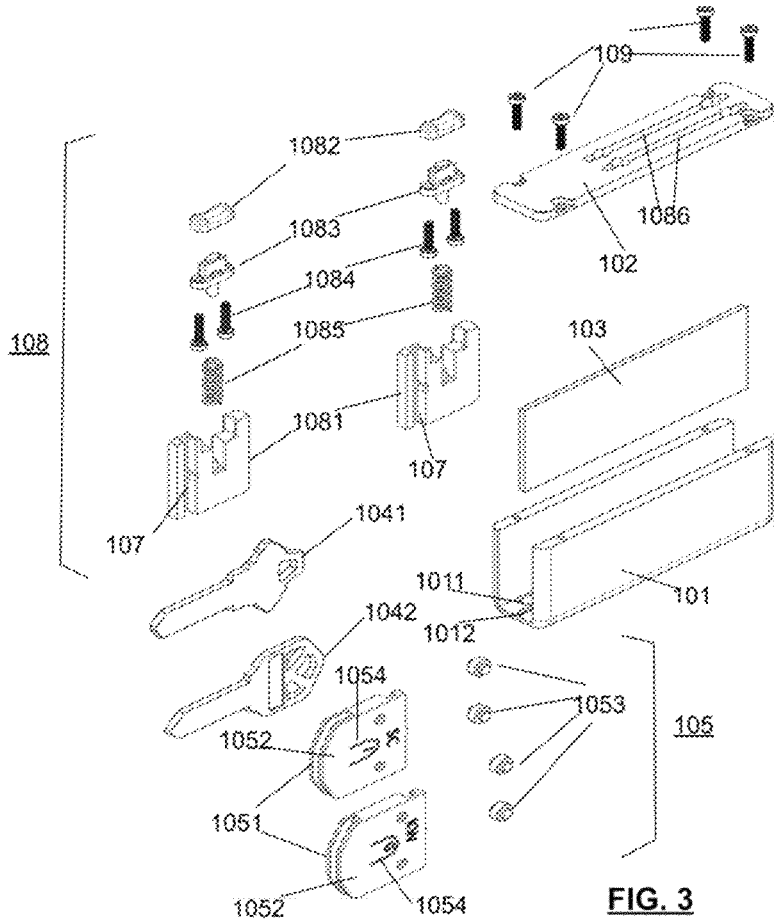
FIG. 3: depicts an exploded view of all components of a preferred embodiment of a key holding device and organizer according to the invention.

As seen in FIGS. 1 & 2, the key holding device 100 comprises a bottom case 101, a top cover 102, at least one key holder 105 to store and retrieve the key 104 held in the key holder 105. The bottom case further includes at least one clear rectangular divider 103 placed between keys 104. There is also a groove/platform 1011, as seen in FIG. 3, running lengthwise on the inside of the base of the bottom case 101, provided for each key 104. The groove or platform 1011 helps in sliding/ejecting the key 104 out of the bottom case 101 when unlocked and sliding the key 104 back in the bottom case 101 when the device 100 is locked. There is also a channel 1012 running lengthwise on the inside of the base of the bottom case 101 for holding the divider 103 in its place.

FIG. 3 shows an exploded view of all the components of the key holding device 100 of the present invention. In one embodiment, the key holding device holds at least two keys within the device as shown in FIGS. 1-3. In another embodiment, the key holding device can store up to 5 keys within the device.

The key holding device 100 comprises a rectangular top cover 102 having a top surface and perimeter sidewall extending downwards from the top surface wherein the top surface is secured by fasteners 109 over the upper end of the bottom case 103 to form a lid. The top surface of the rectangular top cover 102 consists of at least one long narrow opening 1086.

Figure 4A:
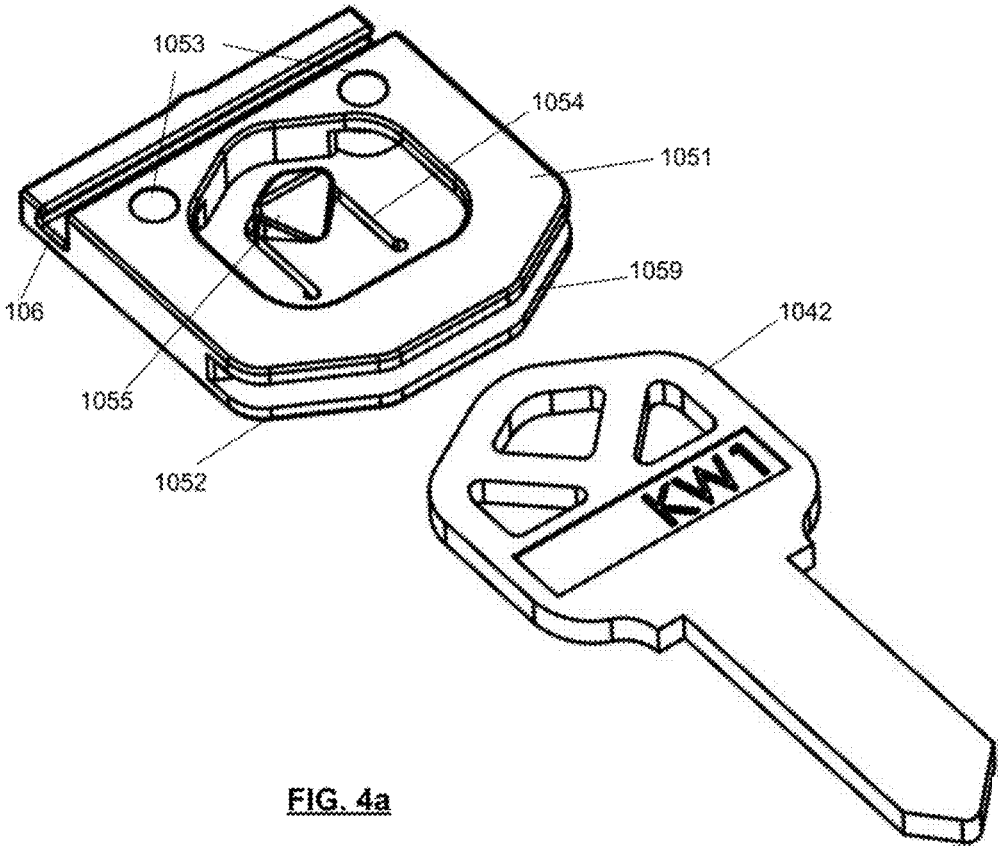
FIG. 4*a*: shows a view of one embodiment of the key holder and a key.

The device 100 of the present invention further comprises a key holder 105 to fit closely around the external head shape of the key 104. The head of the key 104 is held firmly and securely within the key holder 105. As shown in FIG. 4*a*, the key holder 105 includes two plates 1051 and 1052 combined together to create an internal volume 1059 to hold the head of the key 1042. The plates 1051 and 1052 are enclosed on three sides resulting in a U-shaped opening on the fourth side for holding the head of the key blade 104.

Figure 4B:
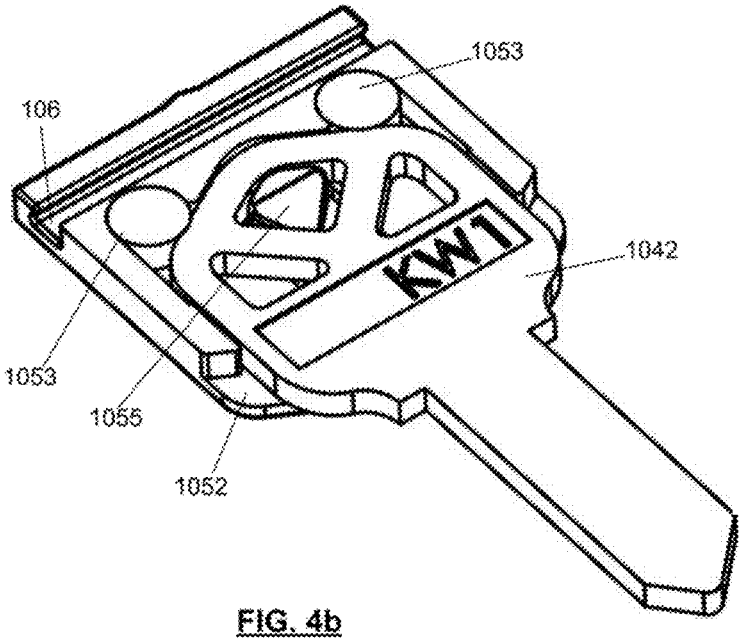
FIG. 4*b*: illustrates an inside view of one embodiment of key holder holding a key.
Figure 4C:
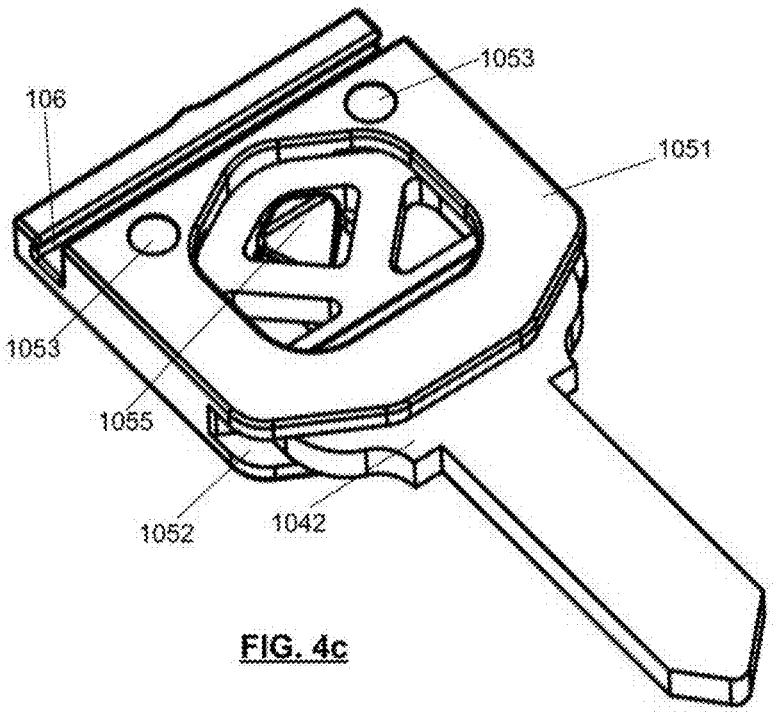
FIG. 4*c*: shows a top view of a key holder holding head of the key.
Figure 5A:
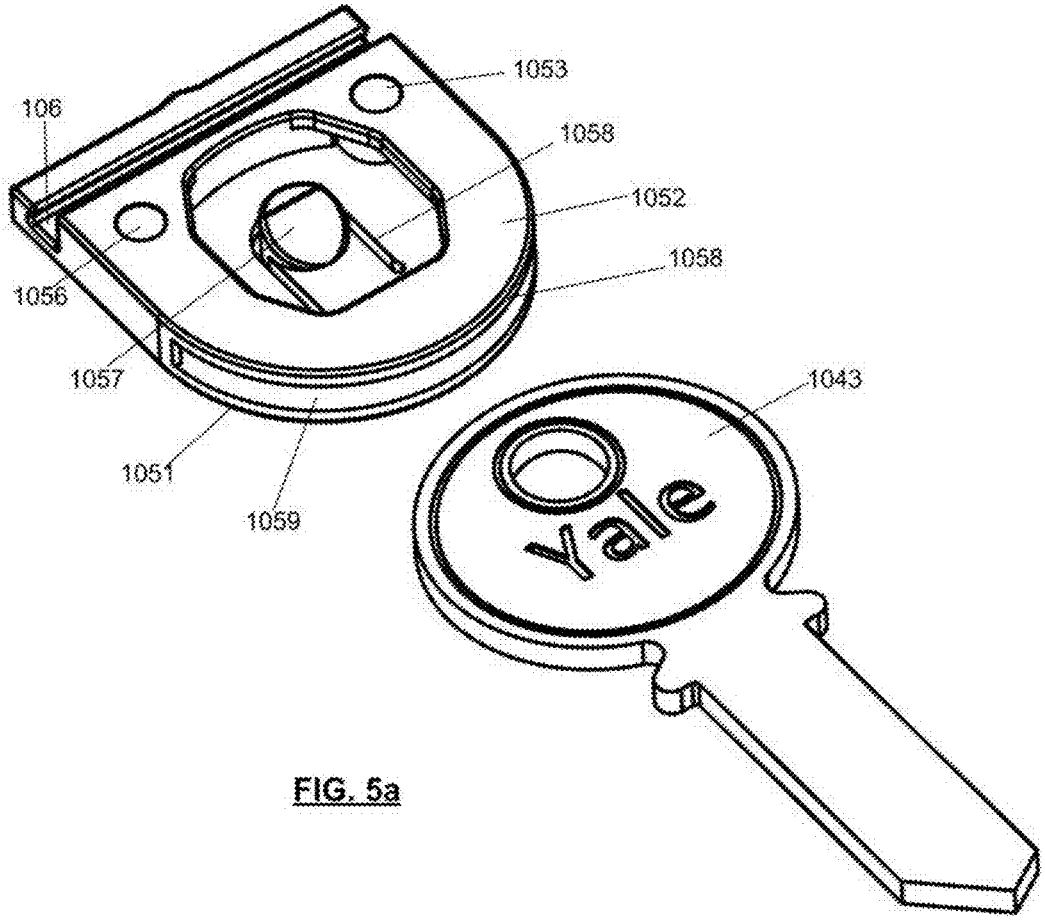
FIG. 5*a*: shows a second embodiment of the key holder and a key.
Figure 5B:
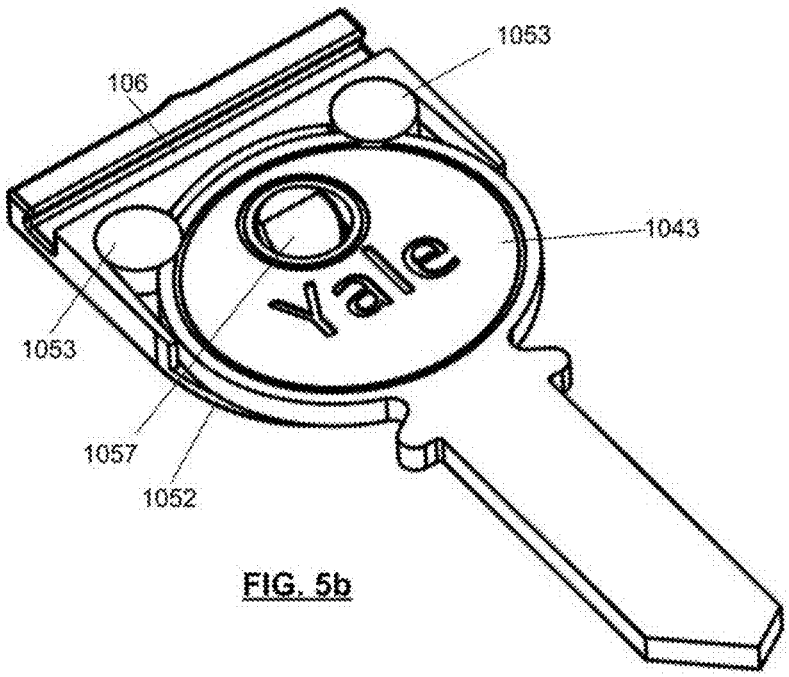
FIG. 5*b*: illustrates an inside view of second embodiment of key holder holding a key.
Figure 5C:
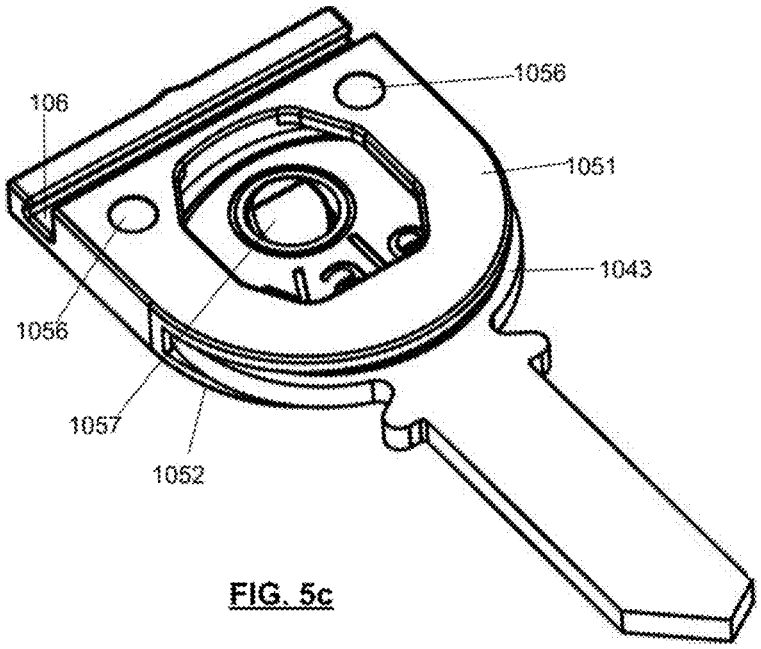
FIG. 5*c*: shows a top view of a key holder holding head of the key.

As illustrated in FIGS. 4*a* & 4*b*, the key holder 105 includes compressible keeper plugs 1053 located on the inside of both plates 1051 & 1052, a snap-fit feature in the center of one plate which includes a projected ramp 1055 and a U-shaped pin 1054 in the center of the second plate 1052 thereby forming a 3 point formation to hold the head of the key 1042 in a secure manner. When the head of the key is inserted, the ramp is pushed back and the key compresses the keeper plugs. The ramp then enters the lanyard point of the key as it snaps back in its place resulting in a strong and secure hold of the key. FIGS. 4*a*, 4*b* & 4*c* illustrates one embodiment of a key holder 105 for a specific key 1042 whereas FIGS. 5*a*, 5*b*, & 5*c* illustrates another embodiment of key holder 105 for another specific key 1043. As the key 1043, as illustrated in FIGS. 5*a*, 5*b*, & 5*c*, has a round head and a round lanyard point, the key holder 105 includes a round projected ramp 1057 and a smooth U-shaped opening 1058 to facilitate better hold for the key 1043.

The key holding device 100 of the present invention further comprises a sliding apparatus 108, as shown in FIG. 3, to slide the key holder 105 and the key 104 in and out of the key holding device 100 through the groove 1011 inside of the base of the bottom case 101. The sliding component apparatus comprises a lower sliding port 1081, and an upper sliding port 1082, both of which are connected to each other through a slider lock 1083. The slider lock 1083 is connected to lower sliding port 1081 and upper sliding port 1082 through screws or fasteners 1084. The sliding apparatus 108 further includes a spring 1085 for compressing the lower sliding port 1081 when the upper sliding port 1082 is actuated by a user which in turn slides the upper sliding port 1082 through the narrow opening 1086 located on the surface of the top cover 102.

The sliding apparatus 108 is connected to the key holder 105 through a snap fit interlock slide connector. The opposite side to the U-shaped opening on the key holder 105 is extended to include an interlock slide connector 106 and the lower sliding port 1081 has an interlock slide connector 107 on one side. The interlock slide connector 106, 107 slides and glides the key holder 105 holding the key blade 104 in and out of the device 100 when the upper sliding port 1082 is glided through the narrow opening 1086 on the top cover 102.

As illustrated in FIG. 2, one key blade 104 stored in the bottom case 101 of the key holding device 100 can be easily retrieved by sliding the upper sliding port 1082*a* whereas the other upper sliding port 1082*b* is stowed in its locked place.

The user can pick a device with specific key holders as per their house key models. The key holder of the present invention has been designed to easily fit the most common house keys in the market like Schlage (SC), as shown in FIG. 3; Kwikset (KW) as shown in FIGS. 3, 4*a*, 4*b*, & 4*c*; Yale Standard (YA), as shown in FIGS. 5*a*, 5*b* & 5*c*. The key holder of the present invention can also be made to hold other keys like, but not limited to, house keys, car keys, padlock keys, commercial keys.

In one embodiment, a wrap or a case is provided wherein the device 100 can be inserted. The said wrap or case can have pockets on the sides to store contents like additional keys. The wrap or case is made up of a slim material like, but not limited to, a leather, fabric, plastic material, cloth or combination.

While many of the fundamental characteristics and features of the ejectable key holder device and organizer have been described herein, with reference to particular embodiments thereof, a latitude of modification, various changes and substitutions are intended in the foregoing disclosure, and it should be apparent that in some instances some features of the invention will be employed without a corresponding use of other features without departing from the scope of the invention as set forth. It should be understood that such substitutions, modifications, and variations may be made by those skilled in the art without departing from the spirit and scope of the invention. Consequently, all such modifications and variations are included within the scope of the invention as defined herein.

What is claimed is:

1. A key holding device for holding and organizing at least two off-the shelf, unmodified keys, wherein said key holding device comprises:

a u-shaped rectangular bottom case comprising a base and a perimeter sidewall extending upwardly from two opposite sides of the base, wherein the perimeter sidewall comprises an upper end, and said u-shaped rectangular case thereby providing an internal volume for storage, wherein said u-shaped rectangular bottom case further comprising:

at least two grooves running lengthwise on an inside of the base for each key, wherein a groove of said at least two groove supports sliding and ejecting a key in and out of said key holding device, at least one channel running lengthwise on an inside of the base between said at least two grooves, wherein said at least one channel comprises at least one clear rectangular divider within said at least one channel between said at least two keys;

a rectangular top cover having a top surface and perimeter sidewall extending downwards from the top surface wherein the top surface is secured by fasteners over the upper end of the bottom case to form a lid, wherein said top surface of said rectangular top cover comprises at least two long narrow openings;

at least two holders capable of fitting closely around an external head shape of a key, wherein a key holder of the at least two holder comprises:

two plates enclosed on three sides thereby forming a u-shaped opening on one end for holding a head of a key, and further comprising another side opposite of the u-shaped opening, wherein said another side is extended to include a first interlock slide connector, at least two compressible keeper plugs on an inside of said two plates, a u-shaped snap-fit feature in the center of one plate of said two plates, wherein the u-shaped snap-fit feature comprises a u-shaped pin and a projected ramp in the center, said projected ramp and said keeper plugs compress when a head of a key is inserted, thereby clamping and holding a head of a key blade in place in said key holder of at least two holders; and at least two sliding apparatuses to slide a key held in said key holder of at least two key holders through the groove inside of the base of the bottom case, where a sliding apparatus of said sliding apparatuses comprises:

a lower sliding port with a second interlock slide connector on a side of said lower sliding port, and an upper sliding port which when actuated by the user slides and glides a key in and out of said device, wherein the upper sliding port glides through a long narrow opening of the at least two long narrow openings on the top cover thereby sliding a key in and out of the device wherein the upper sliding port is connected to a slider lock, wherein said slider lock is connected to slide fasteners, where said slide fasteners are connected to a spring, and said spring is connected to said lower sliding port, and wherein the first slide connector connects with the second slide connector thereby connecting the lower sliding port to the key holder.

2. The device of claim 1, wherein said at least two long narrow openings may be two to five openings.

3. The device of claim 1, wherein said device is capable of storing two to five keys.

* * * * *